US011376463B2

(12) United States Patent
Chen

(10) Patent No.: US 11,376,463 B2
(45) Date of Patent: Jul. 5, 2022

(54) SPRING CONNECTOR

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 53 days.

(21) Appl. No.: 16/920,230

(22) Filed: Jul. 2, 2020

(65) Prior Publication Data

US 2022/0001227 A1 Jan. 6, 2022

(51) Int. Cl.

| | |
|---|---|
| ***A63B 21/04*** | (2006.01) |
| ***A63B 5/11*** | (2006.01) |
| ***A63B 21/02*** | (2006.01) |

(52) U.S. Cl.

CPC ..... *A63B 21/0428* (2013.01); *A63B 5/11* (2013.01); *A63B 21/023* (2013.01)

(58) Field of Classification Search

CPC .. A63B 6/00; A63B 6/02; A63B 6/025; A63B 21/021; A63B 21/023; A63B 21/0428; A63B 21/00047; A63B 21/02; A63B 21/025; A63B 21/0407; A63B 5/00; A63B 5/08; A63B 5/11; A44B 13/0011; A63V 21/025; Y10T 24/0428; Y10T 24/3785

See application file for complete search history.

(56) References Cited

U.S. PATENT DOCUMENTS

| | | | | |
|---|---|---|---|---|
| 3,173,539 | A | 3/1965 | Looker | |
| 4,582,319 | A | 4/1986 | Luna | |
| 5,601,311 | A * | 2/1997 | Pfeiffer | B60R 22/24 280/801.1 |
| 2009/0258760 | A1* | 10/2009 | Plante | A63B 5/11 482/29 |
| 2016/0096056 | A1* | 4/2016 | de Boer | A63B 5/11 482/27 |
| 2016/0310774 | A1* | 10/2016 | Publicover | A63B 5/11 |

FOREIGN PATENT DOCUMENTS

WO 2005016464 2/2005

OTHER PUBLICATIONS

Betty Mills, Assembly Instructions CycleEnclosure, Sep. 5, 2008, "https://www.bettymills.com/product_manuals/outdoor/MDMCycleShelter.pdf" (Year: 2008).*

Amazon, https://www.amazon.com/Shan-Trampoline-Accessories-Triangle-10-Pack/dp/B088QYTB8M/ref=sr_1_2?dchild=1&keywords=shan%2Btrampoline%2Bspring%2Btriangle%2Bbuckle&qid=1632161228&sr=8-2&th=1, May 17, 2020, disclosing a triangular trampoline spring linking mechanism with notches at each corner. (Year: 2020).*

Bellicon Mini Trampoline "35. https://www.facebook.com/bellicon.USA/" Nov. 29, 2019 (Year: 2019).*

Shan Trampoline Spring "https://www.amazon.com/Shan-Trampoline-Accessories-Triangle-10-Pack/dp/B088QYTB8M/ref=sr_1_2?crid=3HMIQKSBJDPSR&keywords=shan+trampoline+springs&qid=1645900625&sprefix=shan+trampoline+springs%2Caps%2C90&sr=8-2" May 17, 2020 (Year: 2020).*

* cited by examiner

*Primary Examiner* — Nyca T Nguyen
(74) *Attorney, Agent, or Firm* — Clement Cheng

(57) ABSTRACT

A trampoline has a trampoline frame, springs connecting to the trampoline frame, a trampoline bed, and spring connectors formed on the trampoline bed at a bed edge of the trampoline bed. The spring connectors connect to the springs. A link retainer is formed on the spring connector. The link retainer has a link opening and a link notch. An outer cover has a hook opening and a strap slot. The outer cover covers the link retainer. The hook opening of the outer cover aligns with the link notch of the link retainer, and the strap slot aligns with the link opening of the outer cover.

9 Claims, 6 Drawing Sheets

SPRING CONNECTOR

FIELD OF THE INVENTION

The present invention is in the field of mechanical connectors, namely spring connectors.

DISCUSSION OF RELATED ART

Trampolines can be fun backyard staples of youth. As more users install trampolines, they desire increased safety and performance. In particular, the connection between the trampoline bed and the trampoline frame can be improved.

SUMMARY OF THE INVENTION

A trampoline has a trampoline frame, springs connecting to the trampoline frame, a trampoline bed, and spring connectors formed on the trampoline bed at a bed edge of the trampoline bed. The spring connectors connect to the springs. A link retainer is formed on the spring connector. The link retainer has a link opening and a link notch. An outer cover has a hook opening and a strap slot. The outer cover covers the link retainer. The hook opening of the outer cover aligns with the link notch of the link retainer, and the strap slot aligns with the link opening of the outer cover.

A recessed panel is formed on the outer cover. Bed strap loops are mounted to the bed edge. The bed strap loops engage the strap slot and link opening. An outer vertex is formed on the link retainer. The first indent is to the right of the link notch and the second indent is to the left of the link notch. The link retainer is formed by bending a metal rod to a triangular shape.

A second outer cover can be a different color than the first outer cover. The first outer cover and the second outer color are color-coded and arranged at different locations on a bed edge. The color coding denotes a suggested order of spring installation. Springs connectors formed on the trampoline bed are attached at a bed edge of the trampoline bed. The spring connectors connect to the springs, and the spring connectors are color-coded to suggest an order of spring installation. The spring connectors include at least a first color, a second color, and a third color arranged at different locations on a bed edge. Preferably the spring connectors of the first color are not adjacent to each other, the spring connectors of the second color are not adjacent to each other, and the spring connectors of the third color are not adjacent to each other.

It is an object of the present invention to increase reliability and safety of consumer trampolines.

The following call out list of elements can be a useful guide in referencing the element numbers of the drawings.

20 Trampoline Bed

21 Trampoline Bed Strap
22 Trampoline Bed Strap Loop
23 Trampoline Bed Edge
24 Frame
30 Outer Cover
31 Strap Slot
32 Hook Opening
33 Retainer Crimp Ports
34 Recessed Panel
35 Outer Cover Tip Port
36 Loop Retainer
37 Hook Opening Notch
38 Strap Slot Bend
39 Partition
40 Springs
41 Spring Hook Tip
42 Spring Hook
43 Spring Coil
50 Link Retainer
51 First Link Indent
52 Second Link Indent
53 Link Notch
54 Link Opening
55 First Link Leg
56 Second Link Leg
57 Link Leg Junction
154 outer vertex

DETAILED DESCRIPTION OF THE PREFERRED EMBODIMENT

Figure 1:
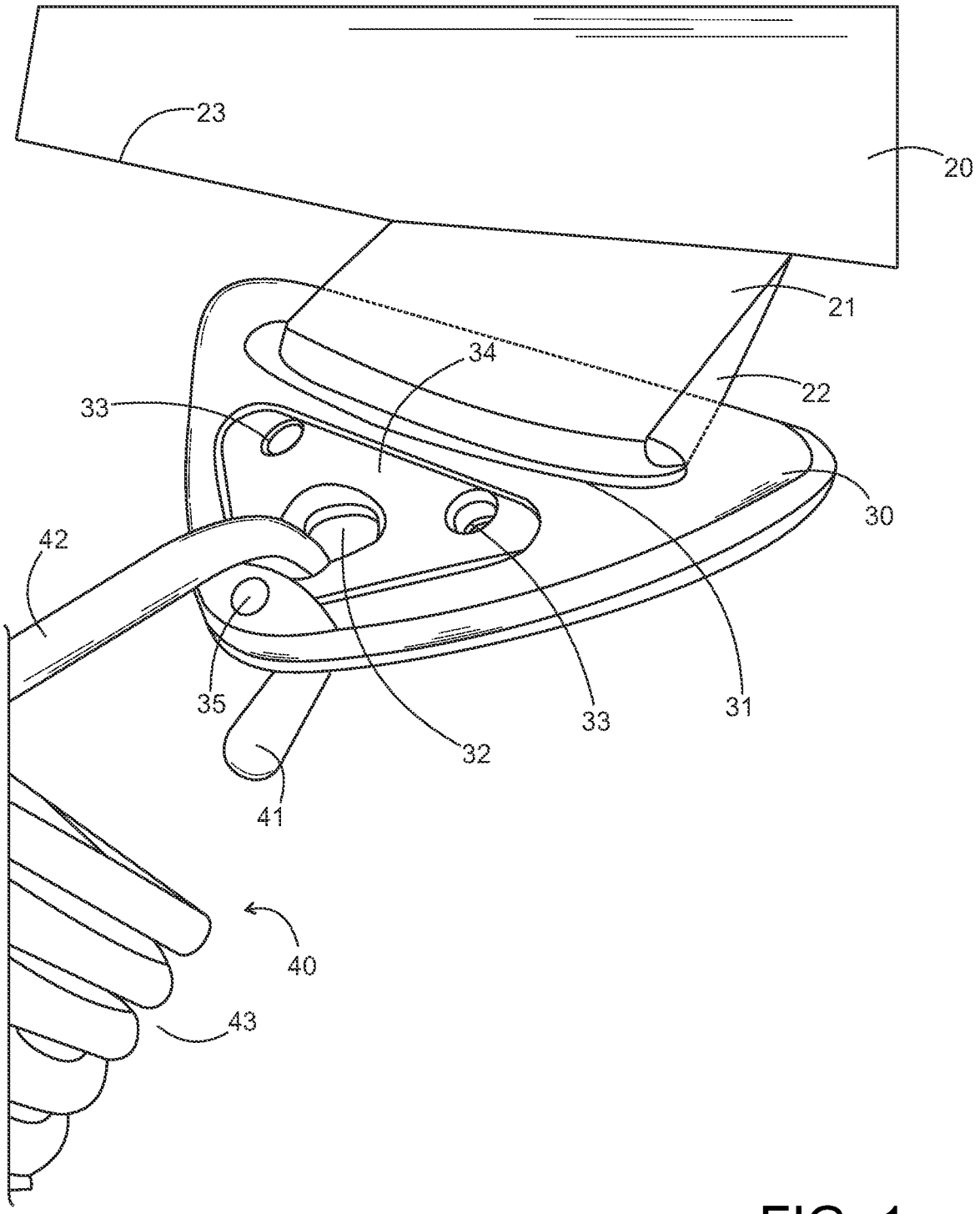
FIG. 1 is a perspective view of the spring connector.

As seen in FIG. 1, a trampoline bed 20 is extended horizontally over a trampoline frame 24 and provides an area for a user to bound. The trampoline bed is preferably made of a UV stabilized plastic woven fabric that is flexible. The trampoline bed is connected at its periphery to a plurality of trampoline bed straps 21. Each of the trampoline bed straps 21 is formed with a trampoline bed strap loop 22.

The trampoline bed has a trampoline bed edge 23. The trampoline bed edge 23 is connected to a trampoline frame via springs 40. Each spring 40 has a connection between the trampoline bed and the frame.

An outer cover 30 has a strap slot 31 that receives a bed strap 21 and a bed strap loop 22. The bed strap loop 22 passes through the strap slot 31 of the outer cover 30. The hook opening 32 receives a spring hook tip 41 that extends from a spring coil 43. The spring hook 42 engages to the hook opening 32 formed on the outer cover 30. The spring 40 is a coil spring having a spring coil 43. The outer cover 30 covers a recessed panel 34. The recessed panel 34 forms a reinforced portion of the outer cover 30. The hook opening 32 is preferably reinforced by a metal portion of the spring connector. The recessed panel 34 can have retainer crimp ports 33 that aligns the recessed panel 34 to the outer cover 30.

The outer cover tip port 35 can be a location where plastic injection molding is injected so that the area toward the tip of the outer cover 30 is the most tightly injected portion of the spring connector. The spring hook tip 41 can be made of a spring steel and extending from the spring hook 42.

Figure 2:
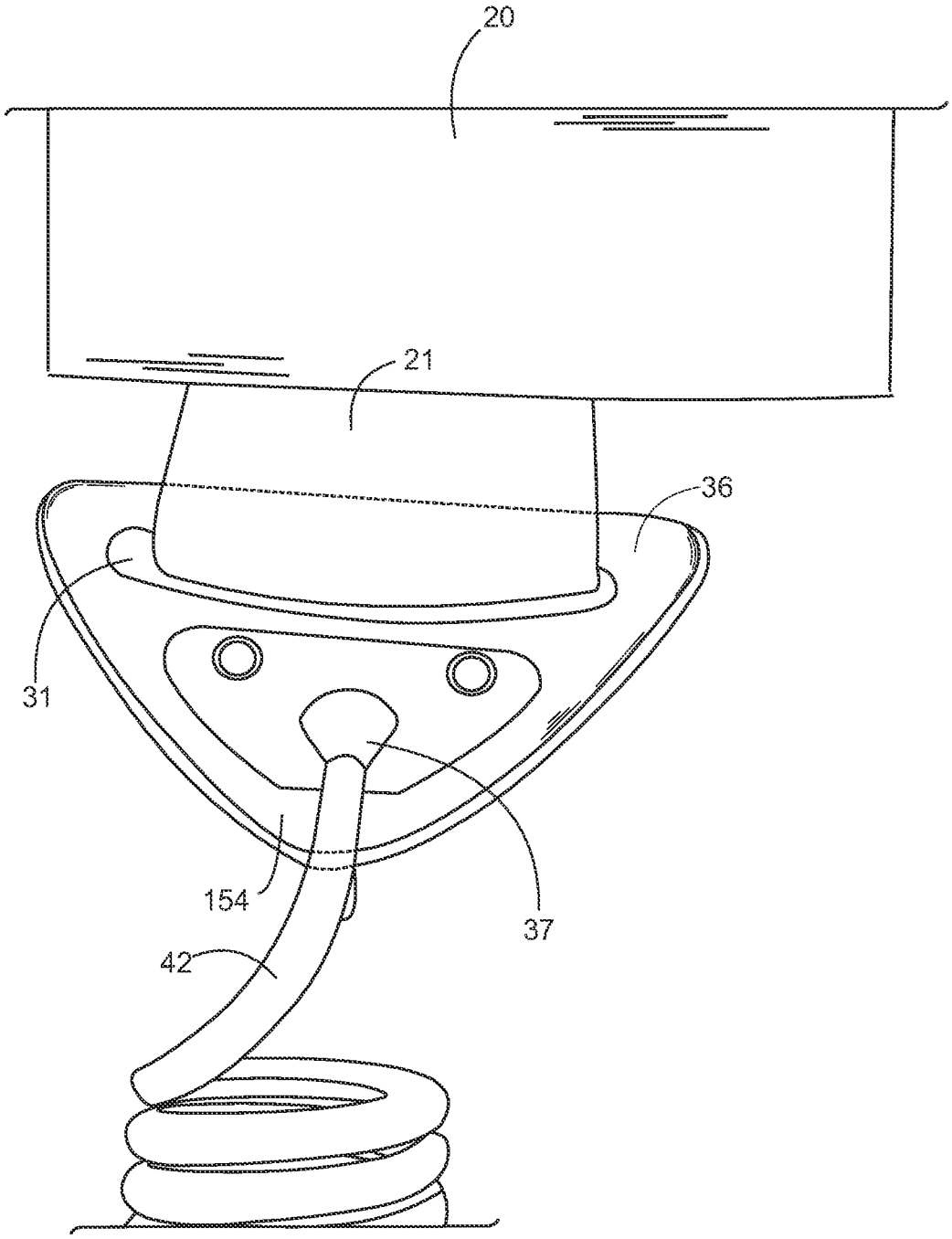
FIG. 2 is a top view of the spring connector.

As seen in FIG. 2, the trampoline bed strap 21 of the trampoline bed 20 engages the strap slot 31 by a loop retainer 36. The loop retainer 36 is oriented perpendicularly to the tension of the spring connector. The hook opening notch 37 is formed on the hook opening 32 and preferably has an angled terminating portion such that it lodges the spring hook 42 to the hook opening 32.

Figure 3:
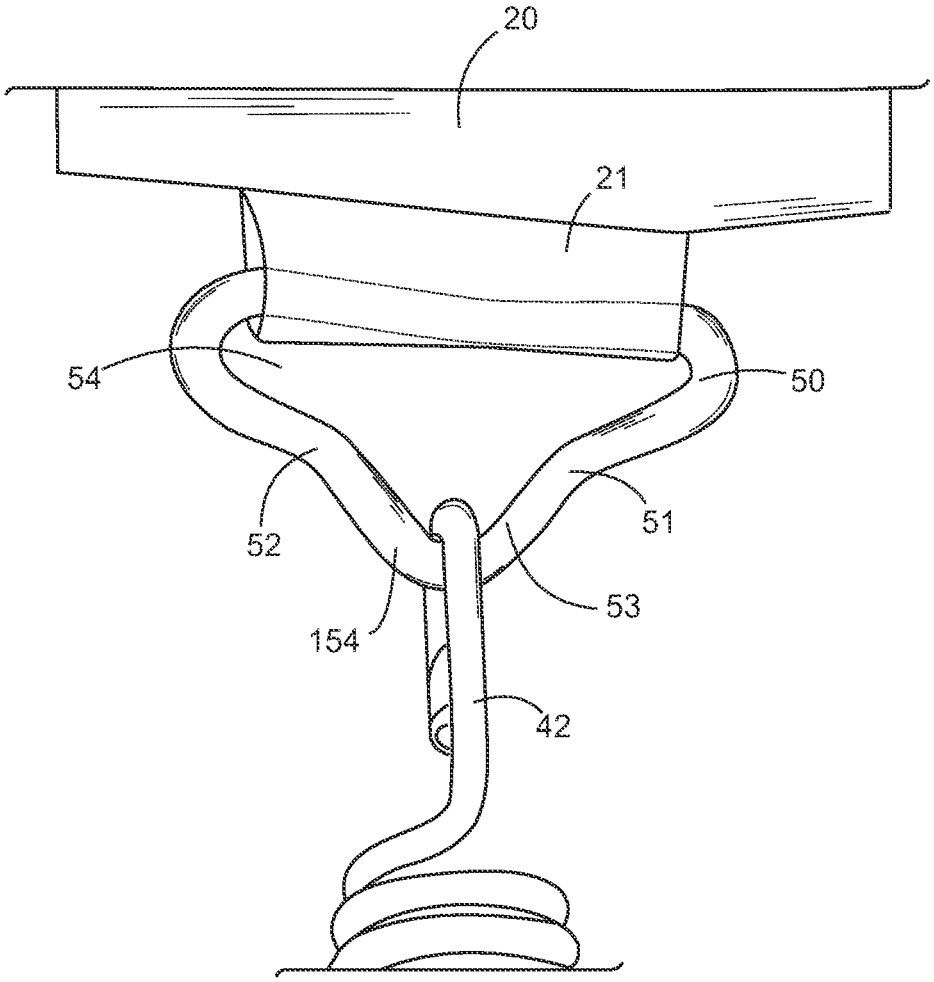
FIG. 3 is a top view of the link retainer connecting to the spring connector.

As seen in FIG. 3, the trampoline bed 20 has a trampoline bed strap 21. A link retainer 50 passes through the trampoline bed strap 21. The link retainer 50 has a link opening 54 that receives the spring hook 42. The link retainer 50 has a first link indent 51 and a second link indent 52. The link notch 53 is formed in the opposite side opposing the trampoline bed strap 21. The link notch 53 is positioned to align with the hook opening notch 37. The link retainer 50 is formed of a loop of metal, which can be stainless steel. A stainless steel rod can be formed in the shape of a loop. The loop is a triangular loop that has the pair of indents. The pair of indents forms the link notch 53 at the outer vertex 154 of the link retainer 50. The link retainer 50 can be made as a loop of bent metal rod, or alternatively can be made as a plate formed from aluminum or steel.

Figure 4:
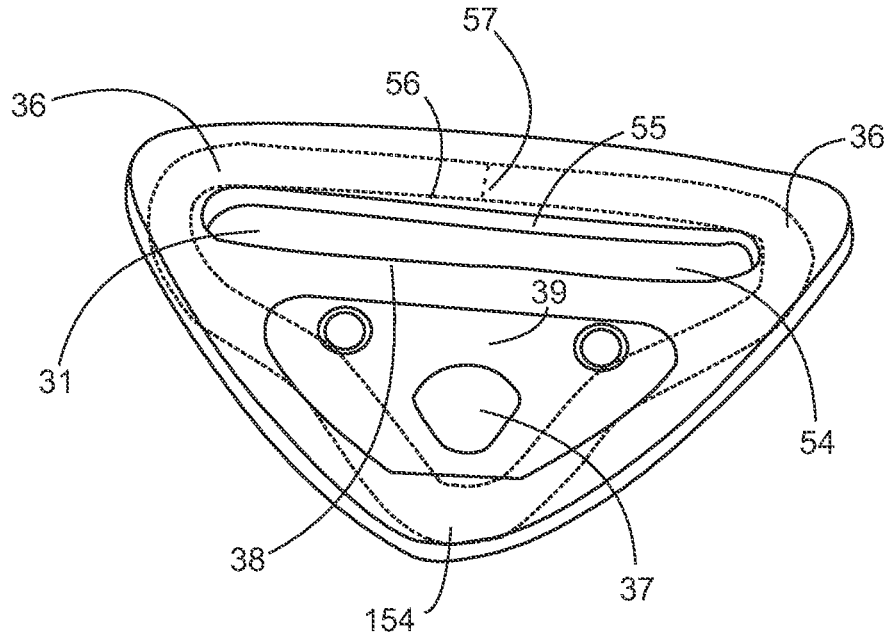
FIG. 4 is a diagram showing the link retainer encapsulated within the spring connector.

The link retainer 50 can be used by itself in the configuration is shown in FIG. 3, or can be covered by the outer cover 30 as seen in FIG. 4. The outer cover 30 cannot be used by itself because it does not have sufficient tensile strength given that it is plastic injection molded, however the outer cover 30 imparts a stability to the link retainer 50 by introducing a partition 39. The partition 39 can be formed as the recessed panel 34. The link retainer 50 can be fed into a mold of a plastic injection molding machine so that it is encapsulated by the outer cover 30 which is a UV stabilized plastic.

As seen in FIG. 4, the outer cover 30 covers the link retainer 50. The link retainer 50 can be formed with a no weld link leg junction 57 which is a gap that is between a first link leg 55 and a second link leg 56. The first link leg 55 is one end of a link retainer 50, and the second link leg 56 is another end of the link retainer 51 when the link retainer 50 is being formed of a steel rod. The gap is protected from being pulled apart because the outer cover 30 binds to the pair of legs and retains them. The gap is preferably very small and the link legs can be abutting so that the gap is minimized. The link leg junction 57 preferably faces the strap slot 31 which is optionally formed with a strap slot bend 38. The link opening 54 thus has a curved profile that can have a radius of curvature somewhat matching a circular trampoline bed. The curved profile can be parallel to the bed edge 23.

It is preferred that the link retainer be covered by a plastic having a harness that absorbs high-frequency vibration. The hook preferably engages both a portion of the plastic and the metal under the plastic. The metal can be exposed under the plastic at the link opening 54.

Preferably, the outer cover 30 comes in color-coded colors such as red, orange, yellow, green, blue, purple so that the first color red is installed to four springs at 90° to each other around a circle such as at 0°, 270°, 180°, and 90°. Then the next color is orange which is installed to four springs at 90° to each other at 45°, 135°, 225°, and 315°. Thus, eight springs can be installed equally so that force is evenly applied during installation. The next color can be yellow which can be installed next to the red outer cover 30, such as left or right of the red outer cover 30. After that yellow installation, springs can be installed to the green colored outer covers 30. The green colored outer covers 30 can be next to the orange colored outer covers 30. Preferably, the colors are easily distinguishable primary or secondary colors. The color progression can produce a rainbow if the first color red, is followed by orange next to red, then yellow next to orange, then green next to yellow, then blue next to green, then purple next to green. Although indigo is a color of the rainbow, it may be too similar to blue to be used. Accordingly, the color scheme of the spring connectors can be modified artistically to account for the color scheme of the trampoline frame, bed and netting.

Figure 5:
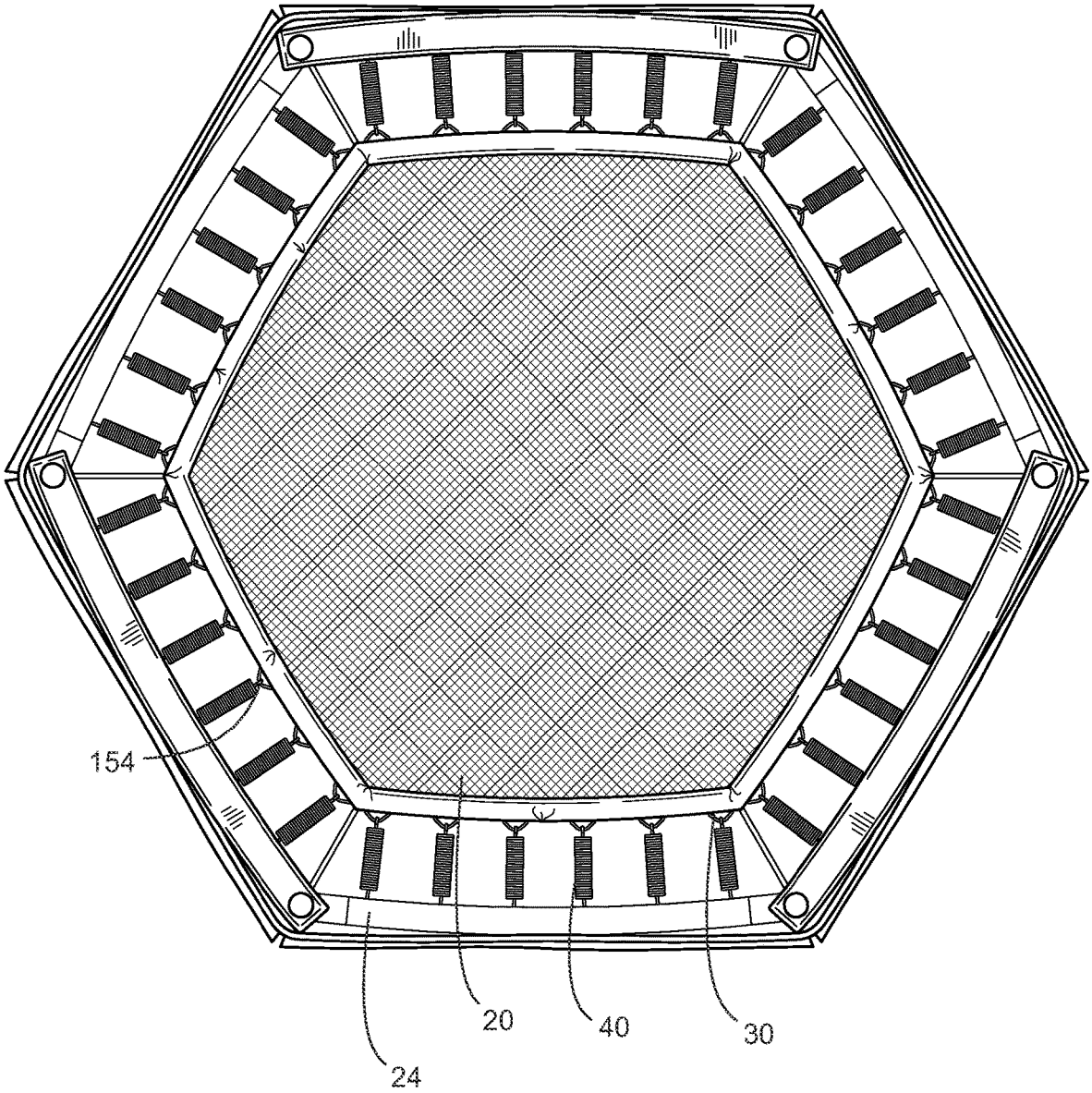
FIG. 5 is a bottom view diagram of the trampoline showing the hexagonal bed and spring connectors.
Figure 6:
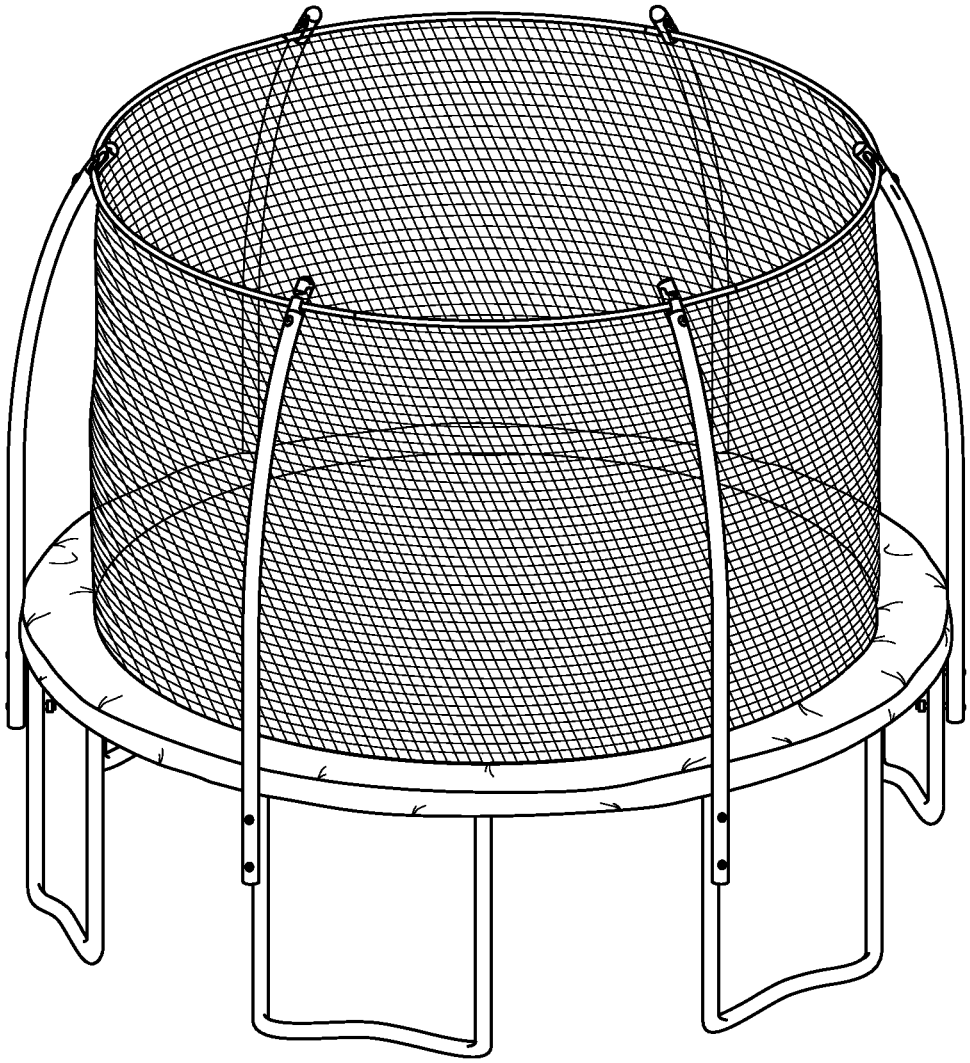
FIG. 6 is a round trampoline to show that the present invention can be installed on a trampoline with a circular bed.

As seen in FIG. 5, the trampoline bed that can be hexagonal, but the trampoline bed can also be circular as seen in FIG. 6.

The invention claimed is:

1. A trampoline comprising:

a. a trampoline frame;

b. springs connecting to the trampoline frame;

c. a trampoline bed;

d. spring connectors formed on the trampoline bed at a bed edge of the trampoline bed, wherein the spring connectors connect to the springs;

e. a link retainer formed on each spring connector, the link retainer has a link opening and a link notch, wherein the link retainer is made of a metal rod with a first link leg and a second link leg meeting at a link leg junction;

f. a first outer cover having a hook opening and a strap slot, wherein the first outer cover covers the link retainer, wherein the hook opening of the first outer cover aligns with the link notch of the link retainer, and wherein the strap slot aligns with the link opening of the first outer cover; and further comprising an outer vertex formed on the link retainer, wherein the outer vertex bends outwardly.

2. The trampoline of claim 1, further comprising a recessed panel formed on the first outer cover.

3. The trampoline of claim 1, further comprising bed strap loops mounted to the bed edge, wherein the bed strap loops engage the strap slot and the link opening.

4. The trampoline of claim 1, further comprising a first link indent and a second link indent, wherein the first indent is right of the link notch and wherein the second indent is left of the link notch, wherein the first link indent and the second link indent bend inwards.

5. The trampoline of claim 1, wherein the link retainer formed by bending a metal rod to a triangular shape.

6. The trampoline of claim 1, further comprising a second outer cover that is a different color than the first outer cover, wherein the first outer cover and the second outer cover are color-coded and arranged at different locations on the bed edge, wherein the color coding denotes a suggested order of spring installation.

7. A trampoline comprising:

a. a trampoline frame;

b. springs connecting to the trampoline frame;

c. a trampoline bed;

d. spring connectors formed on the trampoline bed at a bed edge of the trampoline bed, wherein the spring connectors connect to the springs;

e. a link retainer formed on each spring connector, the link retainer has a link opening and a link notch; and f. a first link indent and a second link indent, wherein the first link indent is right of the link notch and wherein the second link indent is left of the link notch, wherein the link retainer is formed by bending a metal rod to a triangular shape, wherein the first link indent and the second link indent bend inwards, further comprising an outer cover having a hook opening and a strap slot, wherein the outer cover covers the link retainer, wherein the hook opening of the outer cover aligns with the link notch of the link retainer, and wherein the strap slot aligns with the link opening of the outer cover.

8. A trampoline comprising:

a. a trampoline frame;

b. springs connecting to the trampoline frame;

c. a trampoline bed;

d. spring connectors formed on the trampoline bed at a bed edge of the trampoline bed, wherein the spring connectors connect to the springs;

e. a link retainer formed on each spring connector, the link retainer has a link opening and a link notch; and f. a first link indent and a second link indent, wherein the first link indent is right of the link notch and wherein the second link indent is left of the link notch, wherein the link retainer is formed by bending a metal rod to a triangular shape, wherein the first link indent and the second link indent bend inwards, further comprising a first outer cover that is a different color than a second outer cover, wherein the first outer cover and the second outer cover are color-coded and arranged at different locations on the bed edge, wherein the color coding denotes a suggested order of spring installation.

9. The trampoline of claim 8, wherein the spring connectors of a first color are not adjacent to each other, wherein the spring connectors of a second color are not adjacent to each other, wherein the spring connectors of a third color are not adjacent to each other.

* * * * *